United States Patent [19]

Smith

[11] 4,003,624

[45] Jan. 18, 1977

[54] SNAG-PROOF ELECTRIC LAMP BASE HAVING A SINGLE END-CONTACT COMPONENT

[75] Inventor: Chrisman O. Smith, Paris, Tex.

[73] Assignee: Westinghouse Electric Corporation, Pittsburgh, Pa.

[22] Filed: Sept. 19, 1975

[21] Appl. No.: 614,816

Related U.S. Application Data

[63] Continuation of Ser. No. 199,760, Nov. 17, 1971, abandoned, which is a continuation of Ser. No. 742,417, July 3, 1968, abandoned.

[52] U.S. Cl. ..... 339/146; 313/318

[51] Int. Cl.[2] ..... H01J 5/56

[58] Field of Search ..... 339/145 R, 146, 144 R; 313/318

[56] References Cited

UNITED STATES PATENTS

| | | | |
|---|---|---|---|
| 2,185,981 | 2/1940 | Haller | 339/146 |
| 2,504,586 | 4/1950 | Reinker | 339/146 |

FOREIGN PATENTS OR APPLICATIONS

| | | | |
|---|---|---|---|
| 1,186,958 | 4/1959 | France | 339/146 |

*Primary Examiner*—Roy Lake
*Assistant Examiner*—E. F. Desmond
*Attorney, Agent, or Firm*—D. S. Buleza

[57] ABSTRACT

The peripheral edges of the metal eyelet that is embedded in the end of the insulator of an electric lamp base are recessed behind a notched portion of the insulator which prevents the eyelet from being accidentally snagged and "lifted" or otherwise deformed during subsequent bulk processing and shipment of the bases. The notched protective portion of the insulator is formed during the molding of the insulator by making the contactor portion of the eyelet smaller than the corresponding part of the die cavity and centrally positioning the eyelet within the cavity so that the insulating material is forced into the space between the peripheral edges of the contactor portion and the side walls of the molding die.

Positioning and retention of the eyelet in the proper location within the cavity is automatically achieved by means of three spaced radially-extending lugs that are located at the bottom of the molding die and form a pocket which receives eyelets that are fed into the die.

6 Claims, 7 Drawing Figures

INVENTOR
Chrisman O. Smith
BY
D. S. Bulger
AGENT

SNAG-PROOF ELECTRIC LAMP BASE HAVING A SINGLE END-CONTACT COMPONENT

This application is a continuation of application Ser. No. 199,760 filed Nov. 17, 1971 (now abandoned) which application, in turn, is a continuation of application Ser. No. 742,417 filed July 3, 1968 (now abandoned).

BACKGROUND OF THE INVENTION

1. Field of the Invention

This invention relates to electric lamps and has particular reference to an improved base for incandescent lamps and similar devices.

2. Description of the Prior Art

As is well known, the bases used on general lighting type incandescent lamps are provided with a glass insulator which has a sheet metal eyelet embedded in its outer end. The flat circular portion of the eyelet is exposed at the end face of the insulator and serves as the end terminal or contactor for the lamp. A medium-screw type base having such an insulator and eyelet is disclosed in U.S. Pat. No. 2,993,192 issued July 18, 1961, to R. W. Mouat. Another base of this type having an eyelet with a central portion that is dished inwardly to rigidify the sheet metal is disclosed in U.S. Pat. No. 2,987,696 issued June 6, 1961, to H. L. Rudler et al.

While the exposed circular portion of the eyelet in such prior art bases served satisfactorily as an end contact for the lamp, experience has shown that when the fabricated bases are shipped in bulk from the parts factory to the lamp plant (or from the base-making machine to the lamp-making machine in the same plant) the exposed peripheral edges of the eyelets frequently become snagged and are bent outwardly so that the eyelet is "lifted" from the insulator. This defect also occurs during base processing operations before or during lamp manufacture.

Bases with recessed end contacts are known in the art, as evidenced by U.S. Pat. No. 905,478 issued Dec. 1, 1908, to A. Swan, and U.S. Pat. No. 1,460,246 issued June 26, 1923, to H. Hubbell. However, these recessed end contacts were constructed by anchoring a flat metal disc in a previously formed circular recess in the end of the insulator. Thus, the attachment of the contactor disc to the insulator was accomplished by means of a separate time-consuming operation. The added cost and manufacturing difficulties inherent in such an operation make bases of this construction impractical and incompatible with the high-speed mass production techniques employed throughout the industry today.

OBJECTS AND SUMMARY OF THE INVENTION

Objects

It is accordingly the general object of the present invention to provide an improved base for an electric lamp or similar device which can be efficiently manufactured on a mass production basis and subsequently fastened as a unit to the lamp bulb and lead wires on conventional basing machines in the customary manner.

Another object is the provision of an incandescent lamp base having an end contact which is protectively recessed within the insulator portion of the base and is incorporated as an integral part of the base structure during the insulator molding operation.

Summary

The aforementioned objects and other advantages are achieved in accordance with the present invention by utilizing an end terminal that is made from sheet metal and has its peripheral edges recessed behind arcuate ledges that are formed on the end face of the insulator during the base manufacturing operation while the terminal is being embedded in the insulating material.

Specifically, the sheet metal terminal comprises an eyelet having a circular contact portion that is smaller in diameter than the bottom portion of the molding die. A plurality of positioning members, such as three spaced lugs or the like that extend radially into the base cavity, are located at the bottom of the die and are dimensioned to form a pocket which nestingly receives the circular contact portion of the eyelet. The peripheral end edges of this part of the eyelet are thus spaced from the side of the die so that the glass (or other material from which the insulator is made) is forced into the intervening space and forms a series of integral arcuate ledges at the end of the insulator which overlap the peripheral edges of the exposed circular portion of the eyelet and prevents the latter from being accidentally snagged and bent out of shape when the completed bases are being handled or processed. While edge portions of the eyelets are exposed by the notches left in the rim of the insulator by the positioning members in the die, these notches are very narrow and do not present any difficulty as regards the snagging problem, especially since the edges of the eyelet are spaced a considerable distance inwardly from the outer surface of the insulator.

The invention accordingly provides a very simple and inexpensive solution to the eyelet-snagging and bending problem and one which permits the bases to be manufactured and subsequently assembled with the sealed-in lamps in the regular manner on automatic machines presently in use.

BRIEF DESCRIPTION OF THE DRAWING

A better understanding of the invention will be obtained by referring to the accompanying drawing, wherein.

DESCRIPTION OF THE PREFERRED EMBODIMENT

Figure 1:
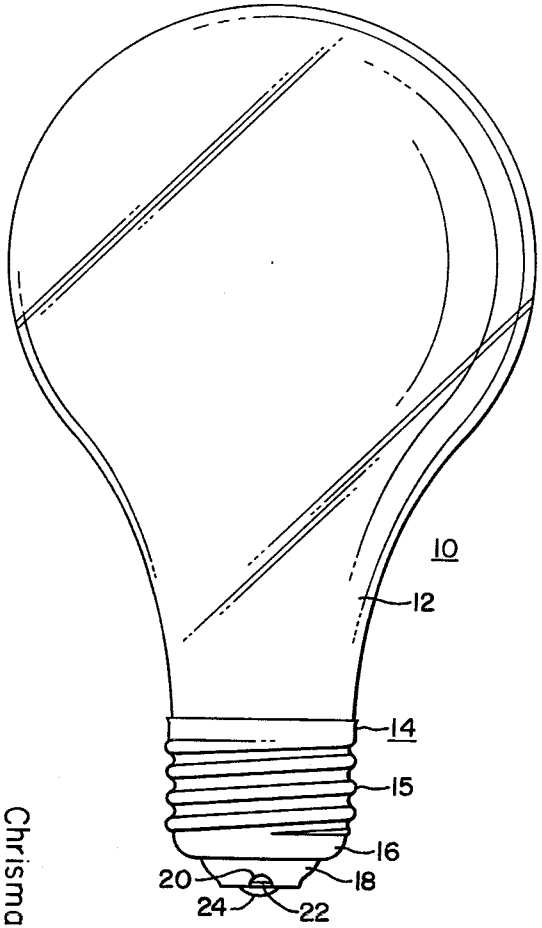
FIG. 1 is a side elevational view of a general lighting incandescent lamp having a base which embodies the present invention.

In FIG. 1 there is shown a general lighting incandescent lamp 10 having a bulbous glass envelope 12 and a base member 14 that is attached to the envelope neck in enclosing relationship with the sealed end of the envelope by basing cement (not shown) in accordance with standard lamp-making practice.

The base 14 consists of a threaded shell 15 of aluminum or of the like that is terminated at its outer end by a domed portion 16 and an insulator 18 that is molded into the bottom of the shell. The insulator 18 is of generally frusto-conical configuration and is composed of glass or other suitable vitreous or plastic material. In accordance with the present invention part of an eyelet 22 of suitable sheet metal, such as brass or the like, is embedded the insulator 18 in a manner such that the peripheral edges of the exposed platelike contactor part of the eyelet are protectively recessed within the confines of the molded insulator. Small segments of the eyelet edges are left exposed by a series of indents such as three arcuate notches 20 that are formed in and circumferentially spaced around the outer rim of the insulator 18.

Figure 3:
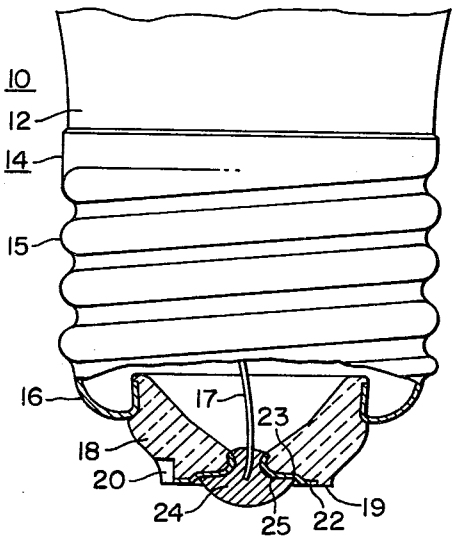
FIGS. 2 and 3 are enlarged plan and longitudinal sectional views of the lamp and base shown in FIG. 1.
Figure 2:
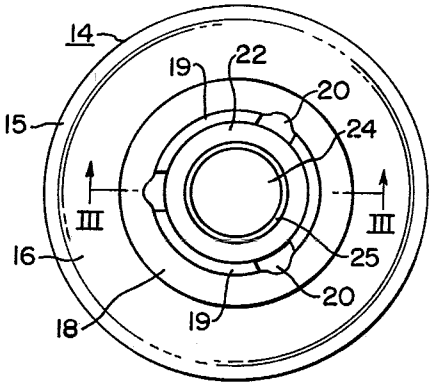

As shown more particularly in FIGS. 2 and 3, the notches 20 are equidistantly spaced around the circular rim of the end face of the insulator 18 and the circular contact portion of the eyelet 22 is located within a shallow depression 23 of circular configuration that is centrally located with respect to the circular end face of the insulator.

The circular depression 23 and spaced notches 20 provide three arcuate shoulders or ledges 19 of substantially uniform thickness and height that constitute the outer rim of the insulator 18, overlap the peripheral edges of the eyelet 22 and are substantially flush with the exposed peripheral surface portions of the eyelet. Thus, the peripheral end edges of the eyelet 22 are protectively recessed behind the contiguous ledges 19 and are incapable of becoming snagged or bent outwardly from the end face of the insulator 18 during subsequent bulk shipment or processing of the completed bases.

Even though small segments of the eyelet edges are exposed by the notches 20, the latter are so narrow and of such depth that the edge segments of the eyelet 22 can only be engaged by a sharply pointed tool or object that is inserted into the notches. The notches 20 are, accordingly, of such configuration that the peripheral end edges of the eyelet 22 are, for all practical purposes, completely recessed within the confines of the insulator 18 in which the eyelet is embedded.

As will be noted in FIG. 3, one of the lead wires 17 is joined to the eyelet 22 by filling 24 of solder or the like which fills the eyelet aperture.

The improved base 14 provides an additional advantage in that it enables the eyelet 22 to be made of thinner sheet metal than heretofore since the eyelet is shielded and need not be as rigid. In the prior art bases the eyelet was made from sheet metal approximately 0.0085 inch thick to give the eyelet sufficient rigidity to resist being bent outwardly if inadvertently snagged. Since this degree of rigidity is no longer required in the recessed eyelet of the present invention, the eyelet thickness has been reduced to about 0.007 inch and tests have indicated that this can be further reduced to 0.005 inch. However, in order to avoid mechanical deformation of the thinner eyelets before they are embedded in the insulator, the central portion 25 of the eyelet 22 is dished inwardly (see FIG. 3) to increase the rigidity of the enlarged contactor end of the eyelet. This dished segment is seated in a similarly shaped recess formed at the bottom of the depression 23 during the insulator-molding operation.

As will also be noted in FIG. 3, the eyelet 22 is located in the aperture of the insulator 18 and this provides a passageway that extends from the outer surface of the eyelet to the interior of the base shell 15 and permits the lead wire 17 to be threaded through the base and soldered to the eyelet.

Another advantage afforded by the invention resides in the fact that it permits the diameter of the circular contact portion of the eyelet 22 to be reduced without changing either the overall configuration or size of the insulator. This not only further reduces the amount of metal required to form the eyelets but permits conventional molding dies to be modified and used to manufacture the improved base.

Figure 5:
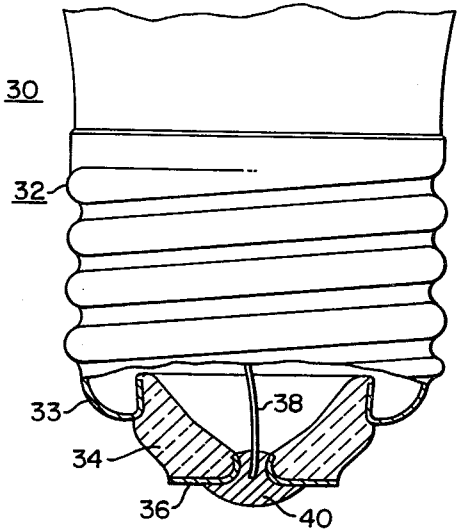
FIGS. 4 and 5 are similar views of a prior art lamp and base.
Figure 4:
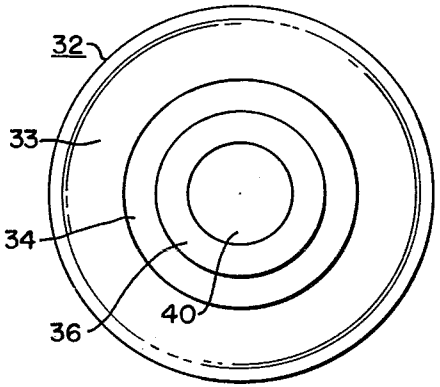

As will be noted in FIGS. 4 and 5, a lamp 30 having a conventional lamp base 32 employs a similarly-shaped insulator 34 that is joined to the domed end 33 of the base shell but is devoid of notches and arcuate ledges. The embedded eyelet 36 is considerably larger in diameter, made of thicker material and its circular contactor portion is disposed on top of the flat end face of the insulator 34 and thus has its peripheral edges entirely exposed. The lead wire 38 is joined to the eyelet by a filling 40 of solder in the usual manner. In the case of medium screw-type bases of the type herein shown, the modified insulator and eyelet construction of the present invention has permitted the eyelet diameter to be reduced from 7/16 inch to ⅜ inch without encountering any problems as regards making a positive contact with sockets now in use.

METHOD AND APPARATUS

Figure 7:
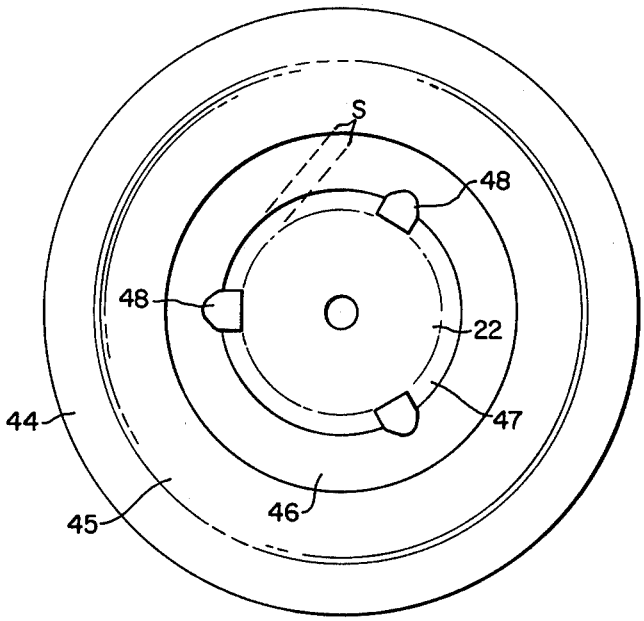
Figure 6:
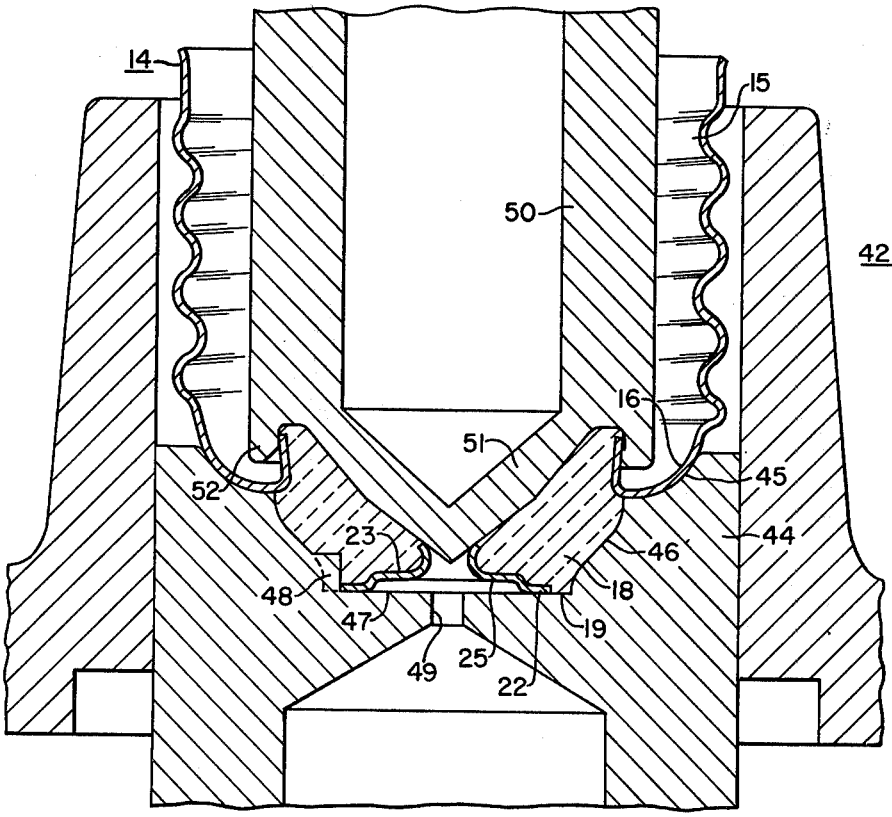
FIG. 6 is a fragmentary longitudinal sectional view of a bottom molding die and a die plunger for manufacturing the base shown in FIGS. 1 to 3; and, FIG. 7 is a plan view of the bottom die component of the base-making apparatus, the circular contact portion of the eyelet being shown in phantom outline for illustrative purposes.

In FIG. 6 there is shown a preferred apparatus 42 for manufacturing the base 14 shown in FIGS. 1 to 3. This apparatus consists of a bottom die 44 that has an annular curved seat 45 at its mouth for nestingly receiving the dome end 16 of the base shell 15, and curved conical side walls 46 that merge with a flat bottom wall 47 that is provided with a centrally located aperture 49. Three equidistantly spaced projections such as lugs 48 (shown more clearly in FIG. 7) are located at the bottom of the die 44 and extend radially from the side walls of the die toward the center of the die cavity. The lugs 48 are so shaped and dimensioned that they form a circular pocket which nestingly receives the circular contact portion of the eyelet 22 and centrally locates the eyelet at the bottom of the mold cavity.

Since the circular bottom portion of the die 44 is of larger diameter than the eyelet 22, the peripheral end edges of the eyelet are spaced a uniform distance S (see FIG. 7) inwardly from the surrounding side wall portions of the die. Thus, when a reciprocably movable die plunger 50 is advanced toward the bottom die 44 the conical shaped end 51 of the plunger forces the charge of molten glass (or other hardenable insulating material that is used) into the spaces between the peripheral edges of the eyelet 22 and side walls of the die and forms an insulator 18 having arcuate ledges 19 that overlie the edges of the eyelet but are flush with its outer surface.

As shown in FIG. 6, the plunger die 48 has a grooved flange portion 52 that engages the inturned collar of the dome end 16 of the base shell 15 and forms a seal therewith which prevents the molten glass from leaking into the interior of the base shell during the molding operation. The tip of the plunger die 50 engages and is seated in the apertured neck portion of the eyelet.

It will be appreciated from the foregoing that the objects of the invention have been achieved in that an improved lamp base has been provided which has an integral protectively recessed end contact and can be efficiently and economically manufactured by making small but critical changes in the base manufacturing techniques and apparatus now in use.

While one embodiment has been illustrated and described, it will be appreciated that various changes in the construction of the base and manufacturing method and apparatus can be made without departing from the spirit and scope of the invention. For example, while an incandescent lamp and a medium-screw type base have been shown, the invention is applicable to other types of lamps and devices (high-pressure mercury vapor lamps, screw-in fuses, etc.) and other kinds of bases, such as mogul, bayonet, three-lite bases, etc.

Also, three spaced axially-extending pins can be used in place of the three radially-extending lugs 48 at the bottom die 44 to form the circular eyelet-receiving pocket. In such a case, axial grooves would be formed in the end face of the insulator and the eyelet would be almost entirely recessed. Alternatively, centering of the eyelet 22 in the bottom die 44 can be achieved by a single hollow pin or the like that engages the apertured neck portion of the eyelet and is attached to the bottom wall of the die.

I claim as my invention:

1. As a new article of manufacture that can be handled en masse without causing the articles to snag and damage one another, a base component for an electric lamp or similar device comprising, in combination;

a metal shell, a molded insulator that is integral with and extends beyond an end of said shell and is terminated by an end face that has an outer peripheral rim, said insulator having a shallow centrally-located depression in its end face and an aperture that extends through said insulator and merges with said depression, and a sheet metal eyelet that is embedded in and is thus an integral part of said insulator, said eyelet having a deformable plate-like contactor portion at one end that is disposed on the end face of said insulator and within the shallow depression thereat so that the peripheral edges of said contactor portion are protectively recessed behind the adjacent peripheral rim of said insulator that surrounds said depression, said eyelet being located in the aperture in said insulator and defining a lead-wire passageway that extends from the outer surface of the contactor portion of said eyelet to the interior of said metal shell, and the outer peripheral rim of said insulator having a plurality of spaced indents therein that merge with said depression and together therewith define a plurality of ledges that are substantially flush with the outer surface of the contactor portion of said eyelet.

2. The base component of claim 1 wherein;

the end face of said insulator, the shallow depression therein, and the contactor portion of said eyelet are of circular configuration and the ledges on the outer peripheral rim of the insulator are thus of arcuate shape, said molded insulator comprises a body of vitreous material of frusto-conical configuration, the recessed peripheral edges of said eyelet are contiguous with said arcuate ledges, said indents comprise three arcuate notches that are equidistantly spaced along the outer peripheral rim of the insulator, and the central portion of the exposed contactor end of said eyelet is dished inwardly and bonded to a similarly contoured part of the molded insulator which defines the bottom of said depression.

3. The base component of claim 1 wherein said eyelet is composed of sheet metal that has a thickness no greater than about 0.007 inch.

4. The base component of claim 1 wherein said eyelet is composed of sheet metal that has a thickness in the range of from about 0.005 to 0.007 inch.

5. The base component of claim 1 wherein;

a portion of the metal shell is threaded and said base component comprises a medium-screw type base for an electric incandescent lamp, the end face of said insulator and the contactor portion of said eyelet are both of circular configuration, and the circular contactor portion of said eyelet has a diameter no greater than about ⅜ inch.

6. The medium-screw type lamp base of claim 5 wherein;

said molded insulator is composed of glass, said metal shell is composed of aluminum, and said eyelet is composed of brass.

* * * * *